US007365294B2

(12) United States Patent
Park

(10) Patent No.: US 7,365,294 B2
(45) **Date of Patent: *Apr. 29, 2008**

(54) MICROWAVE OVEN

(75) Inventor: Heui Seag Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/690,660

(22) Filed: Oct. 23, 2003

(65) Prior Publication Data

US 2005/0247706 A1 Nov. 10, 2005

(30) Foreign Application Priority Data

Dec. 5, 2002 (KR) ..... 10-2002-0077080

(51) Int. Cl.
*H05B 6/68* (2006.01)

(52) U.S. Cl. ..... 219/761; 219/716; 361/103

(58) Field of Classification Search ..... 219/761, 219/760, 481, 517; 336/55, 165, 98, 37, 336/103, 145, 148; 361/104, 41, 35, 38, 361/93.5, 836, 663, 103, 37
See application file for complete search history.

(56) References Cited

U.S. PATENT DOCUMENTS 1,571,300 A * 2/1926 Reed ..... 29/890.039
2,053,944 A * 9/1936 Cooney ..... 200/81.5
3,819,899 A 6/1974 Wallin et al.
4,027,205 A * 5/1977 Frederick ..... 361/694
4,085,395 A 4/1978 Billerbeck et al.
4,169,965 A * 10/1979 Cronin ..... 174/15.3
4,337,820 A * 7/1982 Pierce ..... 165/11.1
4,523,169 A * 6/1985 Hay ..... 336/60
5,625,520 A * 4/1997 Lim ..... 361/103

FOREIGN PATENT DOCUMENTS

| | | |
|---|---|---|
| EP | 655877 A2 | 11/1994 |
| EP | 783239 A1 | 7/1997 |
| EP | 1056101 A2 | 11/2000 |
| FR | 2742598 | 6/1996 |
| JP | 48-51204 | 10/1971 |
| JP | 61-91713 | 6/1986 |
| JP | 63-62126 | 3/1988 |

(Continued)

OTHER PUBLICATIONS

Japanese Office Action issued on Sep. 5, 2006 with respect to Japanese Patent Application No. 2003-369461, which corresponds to the above-referenced application.

(Continued)

*Primary Examiner*—Quang Van
(74) *Attorney, Agent, or Firm*—Staas & Halsey LLP

(57) ABSTRACT

A microwave oven, including a transformer assembly accommodating a transformer and filled with a cooling material to cool the transformer; and a temperature-sensitive switch electrically connected to the transformer to shut off power when a temperature of a surface of the transformer assembly is a predetermined overheating temperature.

25 Claims, 7 Drawing Sheets

FOREIGN PATENT DOCUMENTS

| | | | |
|---|---|---|---|
| JP | 03161911 A | * | 7/1991 |
| JP | 6-151054 | | 5/1994 |
| JP | 7-245871 | | 9/1995 |
| JP | 9-17642 | | 1/1997 |
| JP | 11-16740 | | 1/1999 |
| JP | 11016740 | | 1/1999 |
| JP | 2001-76939 | | 3/2001 |
| JP | 2003-332148 | | 11/2003 |
| JP | 2004-186674 | | 7/2004 |

OTHER PUBLICATIONS

Chinese Office Action issued on Sep. 8, 2006 with respect to Chinese Patent Application No. 200310114107.0, which corresponds to the above-referenced application.

Japanese Office Action issued on Feb. 21, 2006 with respect to Japanese Patent Application No. 2003-369461, which corresponds to the above-referenced application.

* cited by examiner

MICROWAVE OVEN

CROSS-REFERENCE TO RELATED APPLICATIONS

This application claims the benefit of Korean Patent Application No. 2002-77080, filed Dec. 5, 2002, in the Korean Intellectual Property Office, the disclosure of which is incorporated herein by reference.

BACKGROUND OF THE INVENTION

1. Field of the Invention

The present invention relates to a microwave oven, in which a transformer assembly having an improved cooling structure is provided with a temperature-sensitive switch to detect the temperature of a surface of the transformer assembly, shutting off power at an overheating temperature and, thus, preventing a transformer from becoming overheated.

2. Description of the Related Art

In general, a transformer of a microwave oven is used to boost a voltage from an external power source and apply the boosted voltage to a magnetron. The transformer is provided in an electrical components area that is partitioned from a cooking cavity, and contains various electrical and electronic parts. The transformer generates heat caused by the resistance of a coil and by generation of eddy current induced by variation of magnetic flux, so the transformer is generally air-cooled by a cooling device including a fan and a fan motor.

As illustrated in FIG. 1, in a high voltage generating unit 5 of a microwave oven equipped with an air-cooled transformer 1, a secondary side of the air-cooled transformer 1 is connected to a magnetron 3 through a voltage multiplier circuit 2.

The transformer 1 includes a primary coil L1 and secondary coils L2 and L3. The primary coil L1 provides input power (110 and 220 VAC). The voltage is boosted through electrical induction by the secondary coils L2 and L3 according to the number of turns. The heater coil L3 preheats the magnetron 3 during an early stage of operation.

The voltage multiplier circuit 2 includes a high voltage capacitor C and a high voltage diode D, and converts a voltage of about 2 KV, boosted by the transformer 1, into a high voltage of about 4 KV and applies the converted voltage to the magnetron 3.

If excessive current is applied to the high voltage generating unit 5 for an extended time, the transformer 1 overheats, and the coils may burn out. Accordingly, a high voltage fuse 4 is connected in series between the transformer 1 and the voltage multiplier circuit 2.

The high voltage fuse 4 becomes open-circuited when the high voltage capacitor C or high voltage diode D is shorted and excessive current flows. Power supplied to the magnetron 3 is shut off when the high voltage fuse 4 becomes open-circuited, so overheating of the transformer 1 is prevented.

The high voltage fuse 4 may be designed to allow electrical lines connected to connecting terminals to be severed when an excessive current of more than a certain value flows inside a protective casing of the high voltage fuse 4. The high voltage fuse 4 is connected to a secondary side, that is, a high voltage side, of the transformer 1, and must be designed to withstand high voltages. Therefore, the transformer is problematic in that the high voltage fuse 4 increases the volume of the transformer 1, it is difficult to install the transformer 1 due to the increased volume, and the manufacturing cost of the transformer 1 is increased.

Further, the high voltage fuse 4 is problematic in that it becomes open-circuited by rush current temporarily generated during normal operation, which reduces the reliability of a device using the high voltage fuse 4.

A method exists of detecting the temperature of an air-cooled transformer and shutting off power depending upon the detected temperature. Because a heat-resistant structure, which can withstand a high temperature (for example, 170° C.), must be provided on which to mount a temperature sensor on an air-cooled transformer to detect the temperature of the air-cooled transformer, this method is not effective in view of the manufacturing cost. While a temperature sensor disposed in the vicinity of a transformer reduces the requirement for a heat-resistant structure, the reliability of temperature measurement deteriorates because the temperature is measured at a position away from the transformer and is ineffective in preventing the overheating of the transformer.

Thus, while the measurement of temperature of a transformer radiating high heat is an easy and inexpensive method of preventing overheating of the transformer, it is difficult to use this method in the air-cooled transformer.

SUMMARY OF THE INVENTION

It is an aspect of the present invention to provide a microwave oven with a transformer cooling structure that simply and inexpensively prevents a transformer from becoming overheated, thus reducing the need for a heat-resistant structure.

Additional aspects and/or advantages of the invention will be set forth in part in the description that follows and, in part, will be obvious from the description, or may be learned by practice of the invention.

To achieve the above and/or other aspects of the present invention, there is provided a microwave oven, including a transformer assembly accommodating a transformer and filled with a cooling material to cool the transformer; and a temperature-sensitive switch electrically connected to the transformer to shut off power when a temperature of a surface of the transformer assembly is a predetermined overheating temperature.

The temperature-sensitive switch may be mounted on an outside of the transformer assembly.

The temperature-sensitive switch may be a thermostat that turns off at the overheating temperature.

The overheating temperature may range from about 80° C. to about 150° C.

The microwave oven includes a primary coil in the transformer that receives an input voltage, wherein the temperature-sensitive switch is connected in series to the primary coil of the transformer.

The microwave oven includes a secondary coil in the transformer that receives and increases an input voltage, wherein the temperature-sensitive switch is connected in series to the secondary coil of the transformer.

The temperature-sensitive switch may include a body containing a reactive material that is sensitive to temperature and that selectively opens and closes contacts in the body; a connecting terminal attached to a top of the body and electrically connected to an external controller; a support attached to a bottom of the body; and a holder attached to a top of the transformer assembly to firmly hold the support.

To achieve the above and/or other aspects according to the present invention, there is provided a microwave oven, which includes a cooking cavity; an electrical components area partitioned from the cooking cavity; a magnetron disposed in the electrical components area to radiate high frequency waves to the cooking cavity; a transformer in the electrical components area to apply a voltage to the magnetron; a container to accommodate the transformer, filled with a cooling material to cool the transformer, and having a base attached to the electrical components area; and a temperature-sensitive switch electrically connected to the transformer to shut off power when a temperature of a surface of the transformer is a predetermined overheating temperature.

The temperature-sensitive switch may be mounted on an outside of the container.

The temperature-sensitive switch may be a thermostat that turns off at the overheating temperature.

The overheating temperature may range from about 80° C. to about 150° C.

The microwave oven includes a primary coil in the transformer that receives an input voltage, wherein the temperature-sensitive switch is connected in series to the primary coil of the transformer.

The microwave oven includes a secondary coil in the transformer that receives and increases an input voltage, wherein the temperature-sensitive switch is connected in series to the secondary coil of the transformer.

The base may form a bracket and be attached to a surface of the electrical components area. The base includes a plate with two ends, and the base is formed by bending each end of the plate downwardly and inwardly to space the transformer from the surface of the electrical components area by a certain distance.

The microwave oven may further include a separate bracket attached to the base. The base includes a plate with two ends, and the base is formed by bending each end of the plate downwardly and outwardly to space the transformer from the surface of the electrical components area by a certain distance.

The temperature-sensitive switch may include a body containing a reactive material that is sensitive to temperature and that selectively opens and closes contacts in the body; a connecting terminal attached to a top of the body and electrically connected to an external controller; a support attached to a bottom of the body; and a holder attached to a top of the transformer assembly to firmly hold the support.

To achieve the above and/or other aspects according to the present invention, there is provided a temperature-sensitive switch for a microwave oven having a transformer housed within a container and a controller, including a body containing a reactive material that is sensitive to temperature; a connecting terminal attached to a top of the body and electrically connected to the controller; a support attached to a bottom of the body; and a holder attached to a top of the container to receive and hold the support, wherein the temperature-sensitive switch is electrically connected to the transformer to shut off power when a temperature of a surface of the transformer is a predetermined temperature.

To achieve the above and/or other aspects according to the present invention, there is provided a transformer assembly for a microwave oven having a magnetron, including a transformer to apply a voltage to the magnetron; a container to house the transformer; a cooling material within the container to cool the transformer; a temperature-sensitive switch electrically connected to the transformer to shut off power when a temperature of a surface of the transformer is a predetermined temperature.

These, together with other aspects and/or advantages that will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and/or other aspects and advantages of the invention will become apparent and more readily appreciated from the following description of the preferred embodiments, taken in conjunction with the accompanying drawings, of which.

DETAILED DESCRIPTION OF THE PREFERRED EMBODIMENTS

Figure 1:
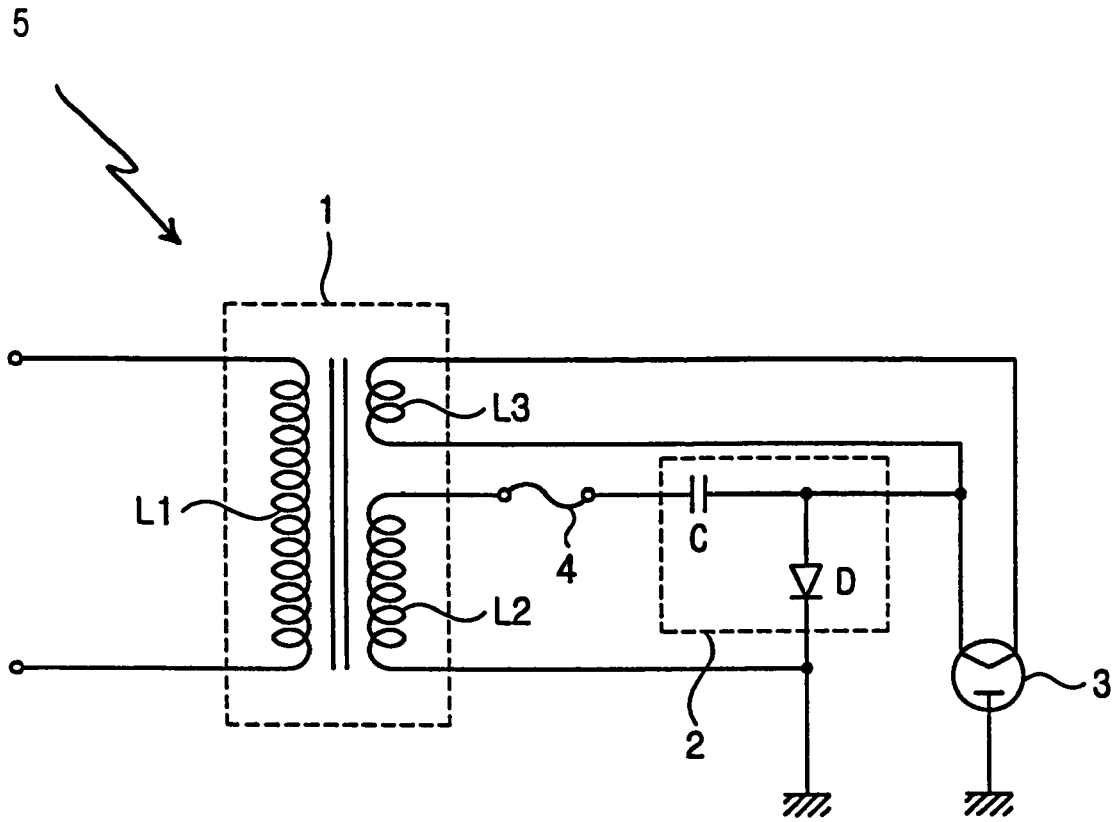
FIG. 1 is a circuit diagram showing a high voltage unit of a microwave oven that uses a high voltage fuse.

Hereinafter, embodiments of the present invention will be described in detail with reference to the attached drawings, wherein the like reference numerals refer to the like elements throughout. The present invention may, however, be embodied in many different forms and should not be construed as being limited to the embodiments set forth herein. Rather, these embodiments are provided so that the present disclosure will be thorough and complete, and will fully convey the concept of the invention to those skilled in the art.

A transformer assembly having an improved cooling structure according to an embodiment of the present invention is described first, and a construction and an operation of a temperature-sensitive switch mounted on the transformer assembly to shut off power at an overheating temperature are described afterwards.

Figure 2A:
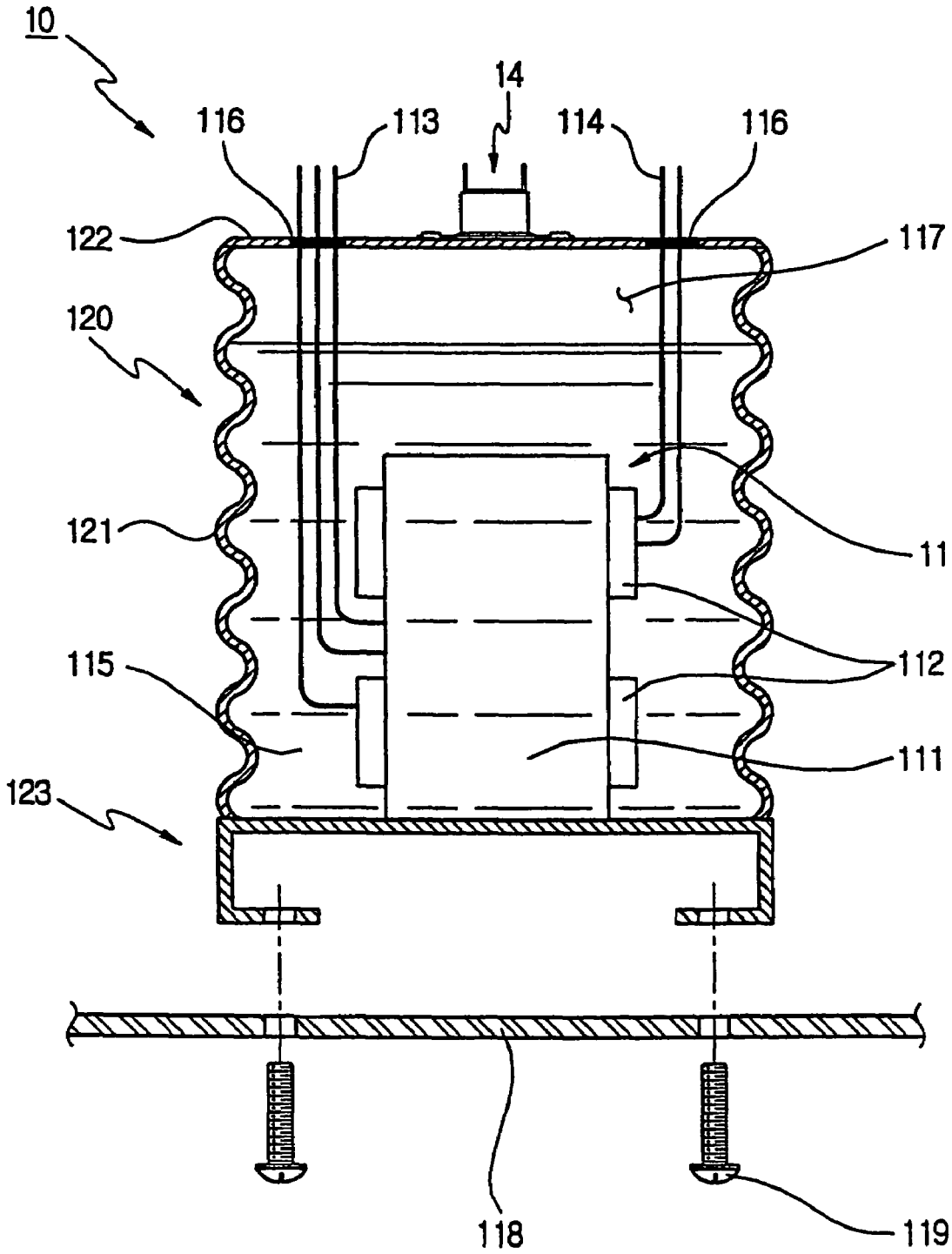
FIG. 2A is a longitudinal section showing a transformer assembly with a temperature-sensitive switch, according to an embodiment of the present invention.

FIG. 2A is a longitudinal section of a transformer assembly 10 having an improved cooling structure, with a temperature-sensitive switch 14 mounted thereon.

In the transformer assembly 10, a transformer 11, including a core 111 and coils 112 wound around the core 111, is accommodated in a sealed container 120 that has a corrugated sidewall 121. The container 120 includes a base 123, to which the transformer 11 is fixedly attached, and a cap portion attached to the base 123 and shaped to accommodate the transformer 11. The cap portion includes a side portion forming the corrugated sidewall 121 of the container 120 and a top portion 122 forming a top of the container 120.

The container 120 is made of copper or aluminum to efficiently dissipate heat generated from the transformer 11.

Liquid and nonconductive oil 115 is used as a cooling material to cool the transformer 11 and is contained in the container 120.

A sufficient amount of oil 115 is provided to submerge the transformer 11. A vacant space 117 is formed in an upper portion of an interior of the container 120 to provide room for the expansion of the oil 115 resulting from the high heat generated by the transformer 11.

An input line 113 that provides external power having a low voltage and an output line 114 are connected to the transformer 11. The input line 113 and the output line 114 are connected to the transformer 11 through respective passage holes 116 formed in the top portion 122 of the container 120. The container 120 must be kept tightly sealed to prevent the oil 115 contained in the container 120 from escaping, so epoxy resin is applied to the perimeter of the passage holes 116, through which the input line 113 and the output line 114 pass, to keep the container 120 tightly sealed.

Figure 2B:
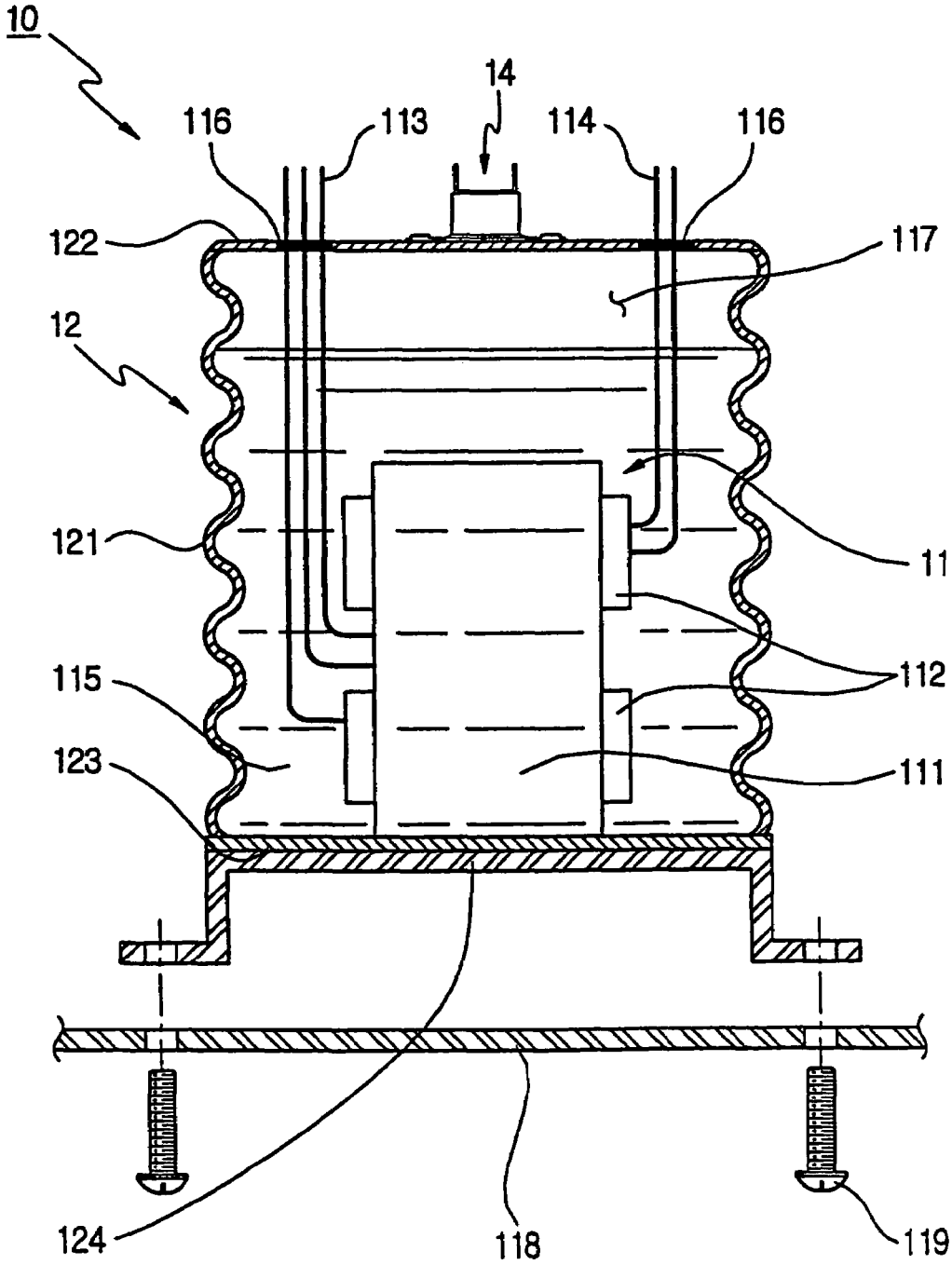
FIG. 2B shows an aspect of the transfer assembly of FIG. 2A.

When the transformer assembly 10 is provided in an electrical components area 16 (FIG. 3) of the microwave oven, the base 123 of the container 120 forms a bracket so that the transformer assembly 10 may be fastened to a surface 118 of the electrical components area 16 by bolts 119. The base 123 is formed by bending two side ends of a plate downwardly and inwardly, which allows the transformer 11 to be spaced apart from the surface 118 of the electrical components area 16 by a certain distance. FIG. 2B shows an aspect of the transformer assembly 10 in which a separate bracket 124 is attached to the base 123. The separate bracket is formed by bending the two side ends of a plate downwardly and outwardly so that the transformer 11 may be spaced apart from the surface 118 of the electrical components area 16.

Figure 2C:
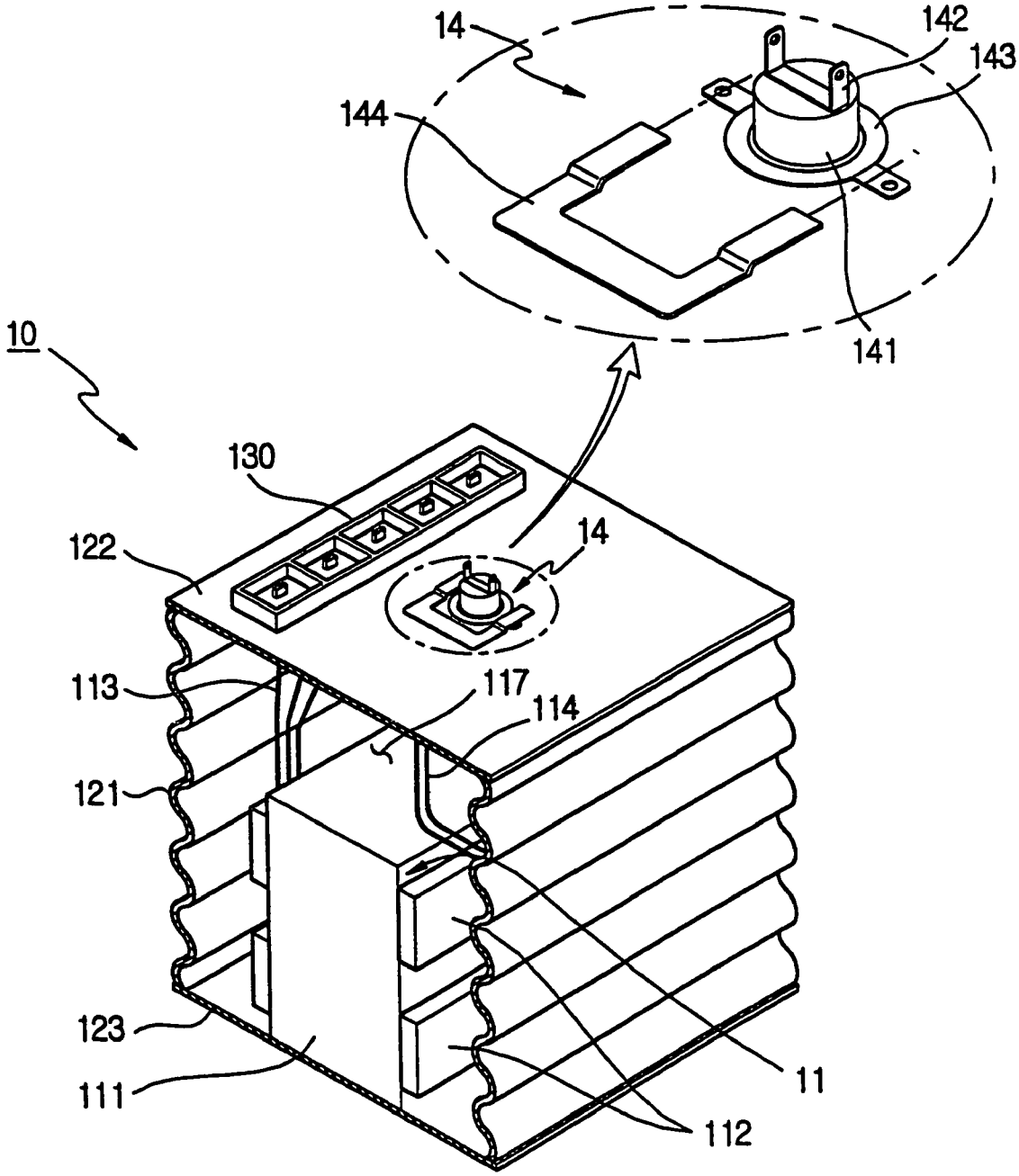
FIG. 2C is a perspective view of the transformer assembly, according to another aspect of the present invention.
Figure 4:
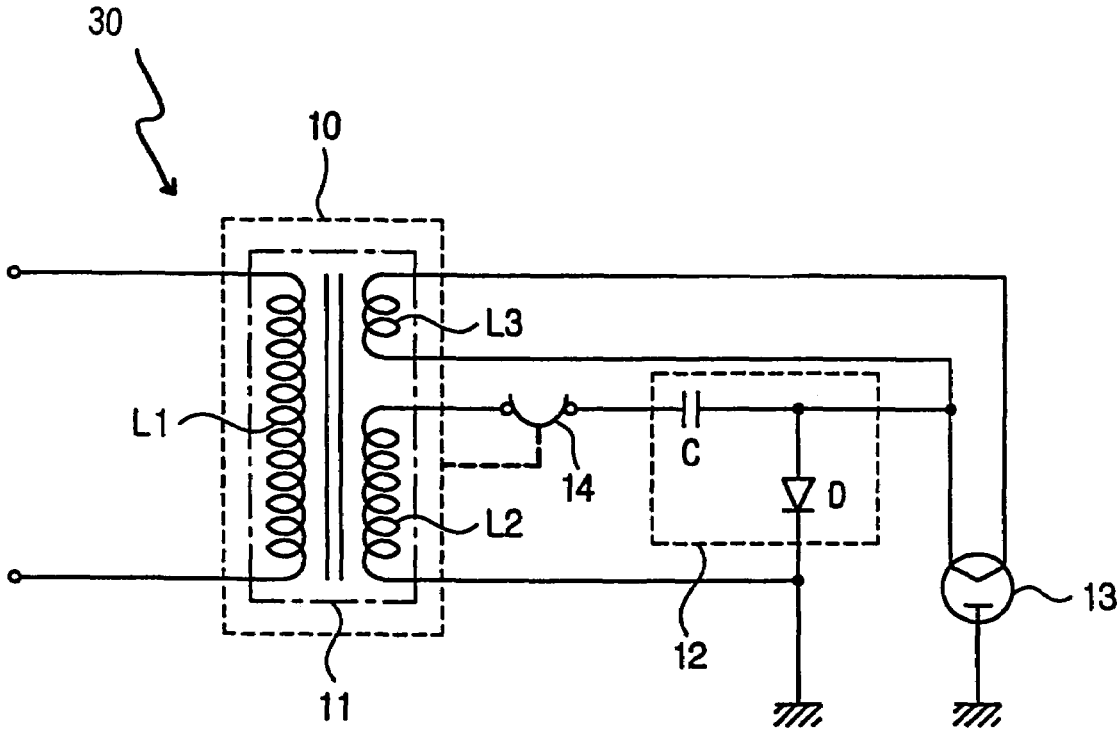
FIG. 4 is a circuit diagram showing a high voltage unit of the microwave oven of FIG. 3.

FIG. 2C shows another aspect of the present invention in which a terminal unit 130 is provided on the top portion 122 of the container 120 to connect the input line 113 and the output line 114 to an external power source and to a magnetron 13 (FIG. 4). The terminal unit 130 allows an inside and an outside of the top portion 122 to be electrically connected to each other while the container 120 is kept tightly sealed. The transformer assembly 10 of this aspect of the present invention is advantageous compared to the transformer assemblies of FIGS. 2A and 2B in that the application of epoxy resin is not required to keep the container 120 tightly sealed.

A temperature-sensitive switch 14 is provided on the top portion 122 of the container 120 and includes a body 141 containing a reactive material that is sensitive to temperature and selectively opens and closes contacts within the body 141, a connecting terminal 142 attached to a top of the body 141 and electrically connected to an external controller (not shown), a support 143 attached to a bottom of the body 141, and a holder 144 welded to the top portion 122 of the container 120. When the transformer assembly 10 is assembled, both ends of the support 143 are inserted into a gap between the holder 144 and the top portion 122 so that assembly can be rapidly and easily performed.

Figure 3:
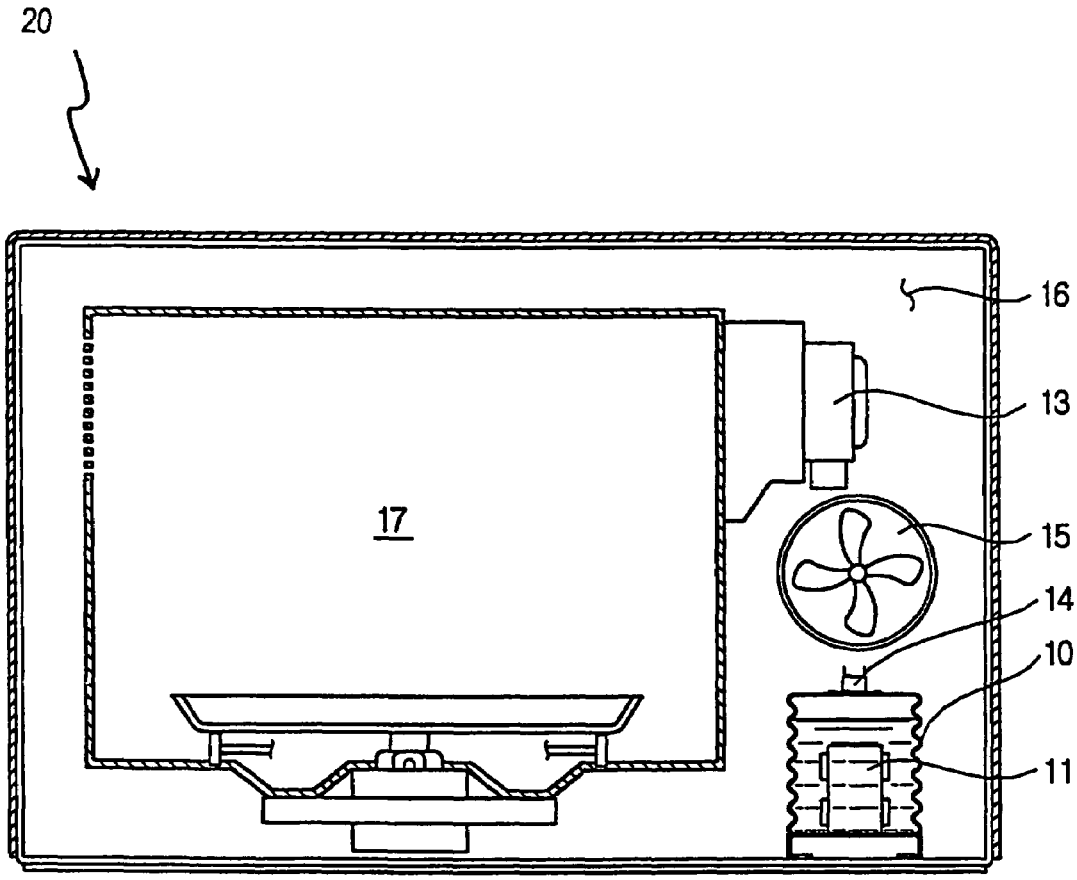
FIG. 3 is a sectional view showing a microwave oven having the transformer assembly, with an improved cooling structure according to the present invention.

FIG. 3 shows a microwave oven 20 with the transformer assembly 10 having an improved cooling structure.

When power is applied to the transformer 11 during operation of the microwave oven 20, power boosted by electromagnetic induction is input from the transformer 11 to the magnetron 13, and the magnetron 13 generates high frequency waves that are radiated into a cooking cavity 17. When the microwave oven 20 is operated for an extended period of time, the transformer 11 radiates high heat resulting from electrical resistance generated in the core 111 and coils 112 of the transformer 11, and the radiated heat is immediately absorbed by the oil 115 and then convected to the container 120. The sidewall 121 of the container 120 has a corrugated structure to provide a larger heat dissipating area, and the transformer 11 is further air-cooled by a cooling fan 15 that forcibly draws external cool air into the electrical components area 16.

The temperature-sensitive switch 14 is designed to satisfy safety standards set by an authority that requires a structure for preventing overheating of the transformer 11. Although the transformer assembly 10 has a cooling structure, the possibility of overheating still exists when excessive current flows through the transformer 11 due to abnormal operation of the voltage multiplier circuit 2, for example, connected to the high voltage side, (i.e., the secondary side) of the transformer 11, so it is necessary to shut off power at an abnormal temperature. Additionally, provision should be made to deal with the overheating of the transformer 11 that results from the decrease of cooling efficiency caused by leakage of the oil 115 and malfunction of the cooling fan 15.

The temperature-sensitive switch 14 is an electrical part that shuts off power to stop operation of the transformer 11 when the temperature of the surface of the transformer assembly 10 rises to more than a certain temperature. The temperature-sensitive switch 14 is a thermostat, for example, that is inexpensive, manufactured to have a small size, and turned off at a certain overheating temperature.

Although the temperature-sensitive switch 14 is not installed to come into contact with the transformer 11, it is installed to be sensitive to the temperature of the surface of the transformer assembly 10 corresponding to the temperature of heat radiated from the transformer 11, so reliability of temperature measurement to prevent the overheating of the transformer 11 is assured.

The temperature-sensitive switch 14, mounted on the transformer assembly 10 having the improved cooling structure, constitutes part of a circuit of a high voltage generating unit (see FIGS. 4 and 5), and to shuts off power when the temperature of the surface of the transformer assembly 10 rises to an abnormal overheating temperature, as shown in FIG. 4.

In a high voltage unit 30 of FIG. 4, the temperature-sensitive switch 14 is connected in series between the secondary coil L2 of the transformer 11 and a voltage multiplier circuit 12, and detects the temperature of the surface of the transformer assembly 10.

The transformer 11 includes the primary coil L1 and secondary coils L2 and L3. The primary coil L1 provides input power (110 or 220 VAC). The voltage is boosted through electrical induction by the secondary coils L2 and L3 according to the number of turns. The heater coil L3 preheats the magnetron 13 during an early stage of operation.

The voltage multiplier circuit 12 includes a high voltage capacitor C and a high voltage diode D, and converts a voltage of about 2 KV, boosted by the transformer 11, into a high voltage of about 4 KV and applies the converted voltage to the magnetron 13.

When the high voltage capacitor C or the high voltage diode D is abruptly shorted, excessive current flows. In this case, the oil 115 heats and the temperature of the surface of the transformer assembly 10 increases due to the emission of high heat from the transformer 11, and the temperature-sensitive switch 14 is turned off when the temperature of the surface of the transformer assembly 10 rises to a certain overheating temperature. Because the overheating temperature may vary depending upon the size or performance of a specific product using the transformer 11, the overheating temperature of the specific product is determined experimentally through a plurality of tests at the time of development. In this aspect of the present invention, the overheating temperature ranges from about 80° C. to about 150° C. in consideration of the material forming the transformer assembly 10. When the temperature-sensitive switch 14 turns off, the power being supplied is shut off, preventing the overheating of the transformer 11.

When the temperature-sensitive switch 14 is electrically connected to the high voltage side of the high voltage generating unit 30 and power applied to the secondary coil L2 of the transformer 11 is shut off at the overheating temperature, as shown in the embodiment of the present invention in FIG. 4, the temperature-sensitive switch 14 must be able to withstand high voltages.

Figure 5:
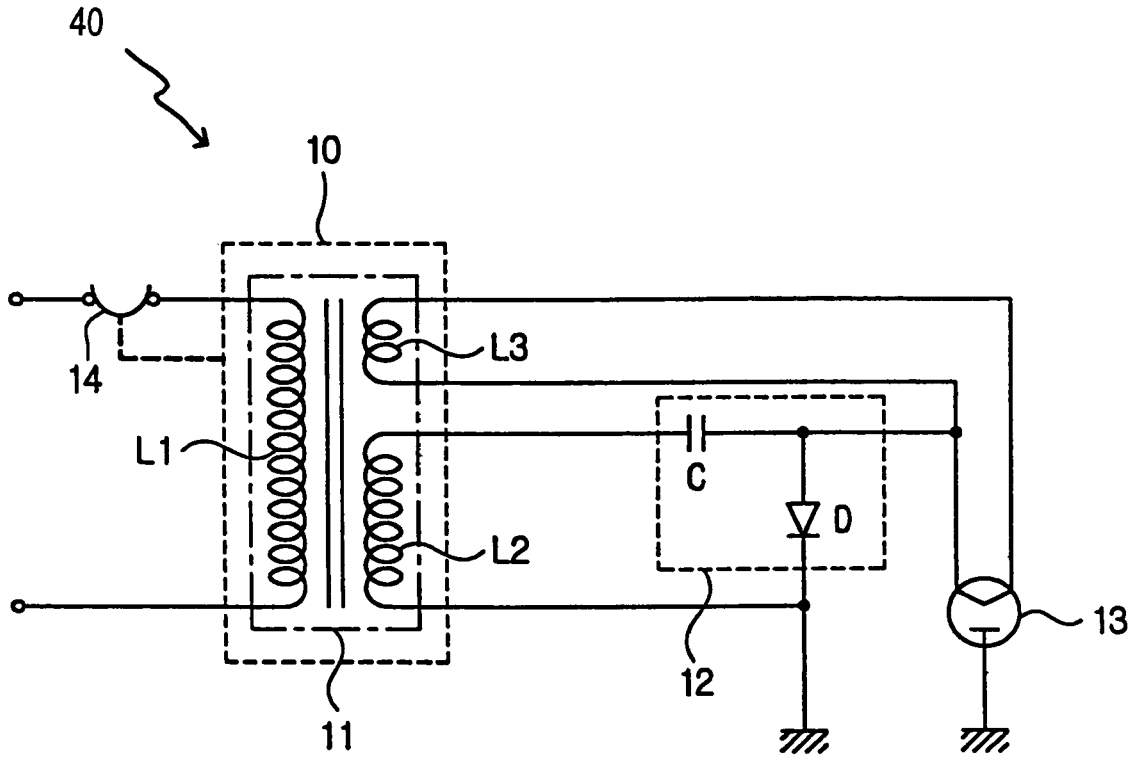
FIG. 5 is a circuit diagram showing another high voltage unit of the microwave oven of FIG. 3, according to another aspect of the present invention.

In an aspect of the present invention, as shown in FIG. 5, the temperature-sensitive switch 14 of a high voltage unit 40 is mounted on the transformer assembly 10, detects the temperature of the surface of the transformer assembly 10, and is connected in series to the primarily coil L1 of the transformer 11 so that power applied to the primary coil L1 of the transformer 11 is shut off at the overheating temperature. In detail, the temperature-sensitive switch 14, electrically connected to the primary coil L1 of the transformer 11, shuts off power applied to the primary coil L1 when the temperature of the surface of the transformer assembly 10 rises to the overheating temperature. The withstand voltage required for the temperature-sensitive switch 14 connected to the primary coil L1 of the transformer 11 is low relative to connection to the secondary coil L2, so the manufacturing cost of the transformer assembly 10 may be advantageously reduced.

As described above, the microwave oven 20 of the present invention is advantageous in that the temperature of the surface of the transformer assembly 10, which increases as heat radiates from the transformer 11, is detected using the temperature-sensitive switch 14, thus assuring reliability of temperature measurement. The temperature-sensitive switch 14 shuts off power at the overheating temperature, thus stably preventing overheating of the transformer 11. The temperature-sensitive switch 14 is inexpensive, thus reducing manufacturing cost of the transformer assembly 10. Also, the temperature-sensitive switch 14 is small in size, thus facilitating ease of assembly of the transformer assembly 10.

Further, the temperature-sensitive switch 14 may be electrically connected to the primary coil L1 of the transformer 11, reducing the withstand voltage and the manufacturing cost of the transformer assembly 10.

Although a few aspects of the present invention have been shown and described, it will be appreciated by those skilled in the art that changes may be made in these aspects without departing from the principles and spirit of the invention, the scope of which is defined in the claims and their equivalents.

What is claimed is:

1. A microwave oven, comprising:

a magnetron;

a transformer assembly accommodating a transformer and filled with a cooling material to cool the transformer and having a base, the transformer to supply power to the magnetron;

an electrical components area attached to the base;

the base formed by bending each end thereof downwardly and inwardly to space the transformer from the surface of the electrical components area by a certain distance;

a temperature-sensitive switch electrically connected to the transformer to shut off external power supplied to the transformer when a temperature of a surface of the transformer assembly is a predetermined overheating temperature, wherein the temperature-sensitive switch is directly mounted on an outside surface of the transformer assembly;

an input line connected to the transformer through a top of the transformer assembly to provide the external power to the transformer; and an output line connected to the transformer through the top of the transformer assembly to provide the power to the magnetron, the input line and the output line being connected to the top of the transformer assembly using epoxy resin to keep the transformer assembly tightly sealed.

2. The microwave oven of claim 1, wherein the temperature-sensitive switch is a thermostat that turns off at the overheating temperature.

3. The microwave oven of claim 1, wherein the overheating temperature ranges from about 80° C. to about 150° C.

4. The microwave oven of claim 1, further comprising a primary coil in the transformer that receives an input voltage, wherein the temperature-sensitive switch is connected in series to the primary coil of the transformer.

5. The microwave oven of claim 1, further comprising a secondary coil in the transformer that receives and increases an input voltage, wherein the temperature-sensitive switch is connected in series to the secondary coil of the transformer.

6. The microwave oven of claim 1, wherein the temperature-sensitive switch comprises:

a body containing a reactive material that is sensitive to temperature and that selectively opens and closes contacts in the body;

a connecting terminal attached to a top of the body and electrically connected to an external controller;

a support attached to a bottom of the body; and a holder attached to a top of the transformer assembly to firmly hold the support.

7. A microwave oven, comprising;

a cooking cavity;

an electrical components area partitioned from the cooking cavity;

a magnetron disposed in the electrical components area to radiate high frequency waves to the cooking cavity;

a transformer in the electrical components area to apply a voltage to the magnetron;

a container to accommodate the transformer, filled with a cooling material to cool the transformer, and having a base attached to the electrical components area;

a temperature-sensitive switch electrically connected to the transformer to shut off an external power supplied to the transformer when a temperature of a surface of the transformer is a predetermined overheating temperature, wherein the temperature-sensitive switch is directly mounted on an outside surface of the container, wherein the base is formed by bending each end thereof downwardly and inwardly to space the transformer from the surface of the electrical components area by a certain distance;

an input line connected to the transformer through a top of the container to provide the external power to the transformer; and an output line connected to the transformer through the top of the container to provide the voltage to the magnetron, the input line and the output line being connected to the top of the container using epoxy resin to keep the container tightly sealed.

8. The microwave oven of claim 7, wherein the temperature-sensitive switch is a thermostat that turns off at the overheating temperature.

9. The microwave oven of claim 7, wherein the overheating temperature ranges from about 80° C. to about 150° C.

10. The microwave oven of claim 7, further comprising a primary coil in the transformer that receives an input voltage, wherein the temperature-sensitive switch is connected in series to the primary coil of the transformer.

11. The microwave oven of claim 7, further comprising a secondary coil in the transformer that receives and increases an input voltage, wherein the temperature-sensitive switch is connected in series to the secondary coil of the transformer.

12. The microwave oven of claim 7, wherein the base forms a bracket and is attached to a surface of the electrical components area.

13. The microwave oven of claim 7, further comprising a separate bracket attached to the base.

14. The microwave oven of claim 13, wherein the base comprises a plate with two ends, and the base is formed by bending each end of the plate downwardly and outwardly to space the transformer from the surface of the electrical components area by a certain distance.

15. The microwave oven of claim 7, wherein the temperature-sensitive switch comprises:

a body containing a reactive material that is sensitive to temperature and that selectively opens and closes contacts in the body;

a connecting terminal attached to a top of the body and electrically connected to an external controller;

a support attached to a bottom of the body; and a holder attached to a top of the transformer assembly to firmly hold the support.

16. The microwave oven of claim 7, wherein the container is made of copper or aluminum to dissipate heat generated from the transformer.

17. The microwave oven of claim 7, wherein the container comprises a cavity in an upper portion of an interior of the container to provide room for the cooling material to expand when heated by heat generated by the transformer.

18. The microwave oven of claim 7, wherein the container comprises corrugated sidewalls to provide a larger heat dissipating area.

19. The microwave oven of claim 18, further comprising a cooling fan that draws external cool air into the electrical components area to cool the transformer.

20. A microwave oven, comprising:

a cooking cavity;

an electrical components area partitioned from the cooking cavity;

a magnetron disposed in the electrical components area to radiate high frequency waves to the cooking cavity;

a transformer in the electrical components area to apply a voltage to the magnetron;

a container to accommodate the transformer, filled with a cooling material to cool the transformer, and having a base attached to the electrical components area;

a temperature-sensitive switch electrically connected to the transformer to shut off an external power supplied to the transformer when a temperature of a surface of the transformer is a predetermined overheating temperature, wherein the base forms a bracket and is attached to a surface of the electrical components area, and the base comprises a plate with two ends, and the base is formed by bending each end of the plate downwardly and inwardly to space the transformer from the surface of the electrical components area by a certain distance;

an input line connected to the transformer through a top of the container to provide the external power to the transformer; and an output line connected to the transformer through the top of the container to provide the voltage to the magnetron, the input line and the output line being connected to the top of the container using epoxy resin to keen the container tightly sealed.

21. A microwave oven, comprising:

a cooking cavity;

an electrical components area partitioned from the cooking cavity;

a magnetron disposed in the electrical components area to radiate high frequency waves to the cooking cavity;

a transformer in the electrical components area to apply a voltage to the magnetron;

a container to accommodate the transformer, filled with a cooling material to cool the transformer, and having a base attached to the electrical components area;

a temperature-sensitive switch electrically connected to the transformer to shut off power when a temperature of a surface of the transformer is a predetermined overheating temperature;

an input line connected to the transformer through a top of the container to provide external power to the transformer; and an output line connected to the transformer through the top of the container to provide power to the magnetron, the input line and the output line being connected to the top of the container using epoxy resin to keep the container tightly sealed.

22. The microwave oven of claim 21, further comprising a primary coil in the transformer that receives an input voltage, wherein the temperature-sensitive switch is connected in series to the primary coil of the transformer.

23. The microwave oven of claim 21, further comprising a secondary coil in the transformer that receives and increases an input voltage and outputs the increased input voltage, wherein the temperature-sensitive switch is connected in series to the secondary coil of the transformer.

24. The microwave oven of claim 21, wherein the cooling material is a liquid or a nonconductive oil.

25. A microwave oven, comprising:

a cooking cavity;

an electrical components area partitioned from the cooking cavity;

a magnetron disposed in the electrical components area to radiate high frequency waves to the cooking cavity;

a transformer in the electrical components area to apply a voltage to the magnetron;

a container to accommodate the transformer, filled with a cooling material to cool the transformer, and having a base attached to the electrical components area;

a temperature-sensitive switch electrically connected to the transformer to shut off power when a temperature of a surface of the transformer is a predetermined overheating temperature;

a terminal unit attached to a top of the container;

an input line connected to the transformer through the terminal unit to provide external power to the transformer; and an output line connected to the transformer through the terminal unit to provide power to the magnetron.

* * * * *

UNITED STATES PATENT AND TRADEMARK OFFICE

CERTIFICATE OF CORRECTION

PATENT NO. : 7,365,294 B2
APPLICATION NO. : 10/690660
DATED : April 29, 2008
INVENTOR(S) : Heui Seag Park It is certified that error appears in the above-identified patent and that said Letters Patent is hereby corrected as shown below:

Column 10, Line 12, change “keen” to --keep--.

Signed and Sealed this

Twenty-sixth Day of August, 2008

JON W. DUDAS
*Director of the United States Patent and Trademark Office*